US006394083B1

(12) United States Patent
Lambertson

(10) Patent No.: US 6,394,083 B1
(45) Date of Patent: May 28, 2002

(54) ADJUSTABLE VENTILATOR CARTRIDGE FILTER

(75) Inventor: Jeffrey S. Lambertson, Danville, CA (US)

(73) Assignee: Gemini Stainless, Inc., Hayward, CA (US)

( * ) Notice: Subject to any disclaimer, the term of this patent is extended or adjusted under 35 U.S.C. 154(b) by 0 days.

(21) Appl. No.: 09/923,878

(22) Filed: Aug. 6, 2001

(51) Int. Cl.[7] ..... F24C 15/20
(52) U.S. Cl. ..... 126/299 D; 126/299 R
(58) Field of Search ..... 126/299 R, 299 D, 126/300, 299 E, 312; 454/56, 61, 67; 55/DIG. 36

(56) References Cited

U.S. PATENT DOCUMENTS

| | | | | | |
|---|---|---|---|---|---|
| 4,011,802 | A | * | 3/1977 | Molitor et al. | 126/299 D |
| 4,072,143 | A | * | 2/1978 | Gaylord | 126/299 D |
| 4,281,635 | A | * | 8/1981 | Gaylord | 126/299 D |
| 5,042,457 | A | * | 8/1991 | Gallagher | 126/299 E |
| 5,540,214 | A | * | 7/1996 | Boudreault | 126/299 E |
| 5,718,219 | A | * | 2/1998 | Boudreault | 126/299 E |
| 5,960,786 | A | * | 10/1999 | Lambertson | 126/299 R |

* cited by examiner

*Primary Examiner*—James C. Yeung
(74) *Attorney, Agent, or Firm*—Townsend and Townsend and Crew LLP

(57) ABSTRACT

An adjustable cartridge filter for use in a cartridge ventilator hood comprises a filter housing including a front wall having a front wall opening and a back wall spaced from the front wall and having a back wall opening. A flow diverter is disposed obstructively at the back wall opening and extends in a space between the front wall and the back wall, causing a flow restriction between the front wall opening and the back wall opening. The flow diverter has a front diverter portion which extends in the space between the front wall and the back wall to divert a flow of a gas from the front wall opening to the back wall opening, so that the gas flows from the front wall opening through a front diverted spacing between the front wall and the front diverter portion in a first direction, around a lower edge of the front diverter portion, through a rear diverted spacing between the back wall and the front diverter portion in a second direction which is substantially opposite from the first direction, to the back wall opening. The flow diverter has a rear diverter portion which is movable to block a portion of the back wall opening, leaving open a choke spacing, and to move the front diverter portion to adjust the length of the flow path through the front diverted spacing and rear diverted spacing. The cartridge filter desirably has a substantially open and unobstructed bottom so that grease does not accumulate inside the cartridge filter, but flows to a grease trough.

24 Claims, 7 Drawing Sheets

ADJUSTABLE VENTILATOR CARTRIDGE FILTER

BACKGROUND OF THE INVENTION

In a typical restaurant kitchen, a plurality of cooking units are lined up side by side in a row under a common exhaust hood. The cooking units may include, for example, ranges, griddles, fryers, and broilers. They all produce air laden with grease, smoke, fumes, moisture, and heat in varying amounts and temperatures. Low temperature cooking equipment such as ranges and griddles produce considerably less amounts of such pollutants in comparison to high temperature equipment such as broilers. Traditional ventilation apparatus are unable to adjust or regulate the airflow in segments within the filter area of the hood. Therefore, to exhaust all of the pollutants and heated air produced from the cooking equipment, traditional ventilation apparatus provide excess ventilation for cooking units such as ranges and griddles in order to capture the large quantities of pollutants produced by broilers and fryers. To increase efficiency, some have modified traditional kitchen ventilators with inlet throat choke attachments in air inlet regions associated with low-pollutant cooking units. The inlet throat choke attachments reduce or throttle the flow of air through portions of the ventilator where the maximum available rate of air removal is not required to remove the pollutants generated by the associated units. U.S. Pat. No. 4,281,635 issued Aug. 4, 1981 to Gaylord discloses one such kitchen ventilator.

The installation of the supplemental inlet throat choke attachments into an existing ventilation hood requires taking apart the ventilation apparatus. The installation, removal, and adjustment of the choke attachments are difficult and time-consuming. Further, pollutants such as grease and particulates carried by the air accumulate on the choke attachments and surrounding areas, which need to be cleaned periodically. Typical water-washed ventilation hoods employ water streams that cannot reach the different sides of the choke attachments disposed at various angles. The accumulation of the pollutants has a negative impact on the ventilation system, and creates unsanitary conditions and fuel for any fire within the ventilation apparatus. In addition, because there are different types and sizes of ventilation hoods and different attachments of the cooking units, the choke attachments will typically need to be custom-designed to achieve the maximum benefits.

Some have designed exhaust hoods that are adjustable to achieve improved ventilation. For instance, U.S. Pat. No. 5,522,377 to Fritz discloses an adjustable exhaust hood that includes an open underside and a grease filter defining an exhaust plenum between the hood and the grease filter and a flow path through the grease filter. A shutter-like panel is slidable into the flow path adjacent to the grease filter for blocking a portion of the flow path to adjust a volume of air flowing through the exhaust hood. Fritz also discloses the use of multiple side-by-side panels.

U.S. Pat. No. 5,960,786 to Lambertson discloses an adjustable cartridge filter for use in a cartridge ventilator hood. The filter has a front wall with a front wall opening and a back wall with a back wall opening. A flow diverter is disposed obstructively at the back wall opening and extends between the front wall and the back wall, causing a flow restriction between the front wall opening and the back wall opening. The flow diverter is adjustable to change the amount of the resistance generated by the cartridge and the size of the air passage through the cartridge filter.

BRIEF SUMMARY OF THE INVENTION

The present invention provides a removable, adjustable ventilation cartridge filter for use in a cartridge ventilator to increase the efficiency of the ventilator by regulating and adjusting the air flow in segments corresponding to different associated cooking units and extracting the maximum amount of pollutants by maintaining high air speed within the cartridge. The cartridge filter has an adjustable flow diverter and choke to control the resistance and speed of the air flow through the cartridge. The cartridge filter fits easily into a track provided as part of a cartridge ventilation hood. As a result, the cartridge filter is easy to install and easy to remove for inspection, adjustment, or cleaning. The flow diverter extends sufficiently far in the space between the front wall opening and back wall opening such that a gas flows from the front wall opening through a front diverted spacing between the front wall and the flow diverter in a first direction, around a lower edge of the front diverter, through a back diverted spacing between the back wall and the flow diverter in a second direction which is substantially opposite from the first direction, to the back wall opening. The sharp angle of turn of about 180° increases extraction of grease or other pollutants in the air flowing therethrough.

In accordance with an aspect of the present invention, an adjustable cartridge filter for use in a cartridge ventilator comprises a filter housing including a front wall having a front wall opening and a back wall coupled to and spaced from the front wall. The back wall includes an upper back wall portion spaced from a lower back wall portion by a back wall opening which is defined between an upper portion edge of the upper back wall portion and a lower portion edge of the lower back wall portion. A flow diverter is disposed obstructively at the back wall opening and is adjustably supported by the housing to move relative to the housing. The flow diverter has a front diverter portion which is disposed between the back wall opening and the front wall and which is spaced from the front wall to define a front diverted spacing. The flow diverter has a rear diverter portion which is adjustably coupled to the back wall to move the front diverter portion in a space between the front wall and the back wall to divert a flow of a gas from the front wall opening to the back wall opening, so that the gas flows from the front wall opening through the front diverted spacing between the front wall and the front diverter portion in a first direction, around a lower edge of the front diverter portion, through the rear diverted spacing between the back wall and the front diverter portion in a second direction which is substantially opposite from the first direction, to the back wall opening.

In some embodiments, the rear diverter portion is adjustably coupled to the back wall to block a portion of the back wall opening to define an adjustable choke spacing equal to a remaining portion of the back wall opening not blocked by the rear diverter portion. The flow diverter is movable between a first position where the rear interface of the flow diverter is disposed at the upper portion edge of the back wall opening and a second position where the rear interface of the flow diverter is disposed between the upper portion edge and the lower edge of the back wall opening with the rear diverter portion blocking a portion of the back wall opening from the upper portion edge of the back wall opening to the rear interface of the flow diverter.

In accordance with another aspect of the invention, an adjustable cartridge filter for use in a cartridge ventilator comprises a front wall having a front wall opening, and a back wall coupled to and spaced from the front wall. The back wall includes an upper back wall portion spaced from a lower back wall portion by a back wall opening which is defined between an upper portion edge of the upper back wall portion and a lower portion edge of the lower back wall portion. A flow diverter is disposed obstructively at the back wall opening and includes a front diverter portion which is disposed between the back wall opening and the front wall and which is spaced from the front wall to define a front diverted spacing and spaced from the back wall to define a rear diverted spacing. The cartridge filter further comprises means for movably coupling the flow diverter to the back wall to move the flow diverter in a space between the front wall and the back wall to divert a flow of a gas from the front wall opening to the back wall opening, so that the gas flows from the front wall opening through the front diverted spacing between the front wall and the front diverter portion in a first direction, around a lower edge of the front diverter portion, through the rear diverted spacing between the back wall and the front diverter portion in a second direction which is substantially opposite from the first direction, to the back wall opening.

In some embodiments, the means is configured to move the flow diverter to change the size of the back wall opening. The flow diverter is movable in a direction substantially parallel to the front wall and the back wall.

In accordance with another aspect of the invention, a cartridge ventilator comprises a ventilator hood, and a cartridge filter housed in the ventilator hood. The cartridge filter comprises a filter housing including a front wall having a front wall opening and a back wall coupled to and spaced from the front wall and having a back wall opening. The cartridge filter further comprises a flow diverter disposed obstructively at the back wall opening and having a front diverter portion spaced from the front wall to define a front diverted spacing and spaced from the back wall to define a rear diverted spacing. The flow diverter has a rear diverter portion coupled to the front diverter and blocking a portion of the back wall opening to define a choke spacing equal to a remaining portion of the back wall opening not blocked by the rear diverter portion. The front diverter portion extends in a space between the front wall and the back wall to divert a flow of a gas from the front wall opening to the back wall opening, so that the gas flows from the front wall opening through the front diverted spacing between the front wall and the front diverter portion in a first direction, around a lower edge of the front diverter portion, through the rear diverted spacing between the back wall and the front diverter portion in a second direction which is substantially opposite from the first direction, to the back wall opening. A rear choke portion is coupled to the ventilation hood and obstructively spaced from the choke spacing.

In some embodiments, the rear choke portion comprises a generally flat surface being larger in area than the choke spacing. The rear choke portion is adjustably coupled to the ventilation hood to move relative to the back wall and choke spacing. The flow diverter is adjustably supported by the filter housing to adjust the choke spacing.

BRIEF DESCRIPTION OF THE DRAWINGS

The preferred embodiments of this invention, illustrating all their features, will now be discussed in detail. These embodiments depict the novel and nonobvious ventilation cartridge filter of this invention shown in the accompanying drawings, which are included for illustrative purposes only. These drawings include the following figures, with like numerals indicating like parts.

DESCRIPTION OF THE SPECIFIC EMBODIMENTS

Figure 1:
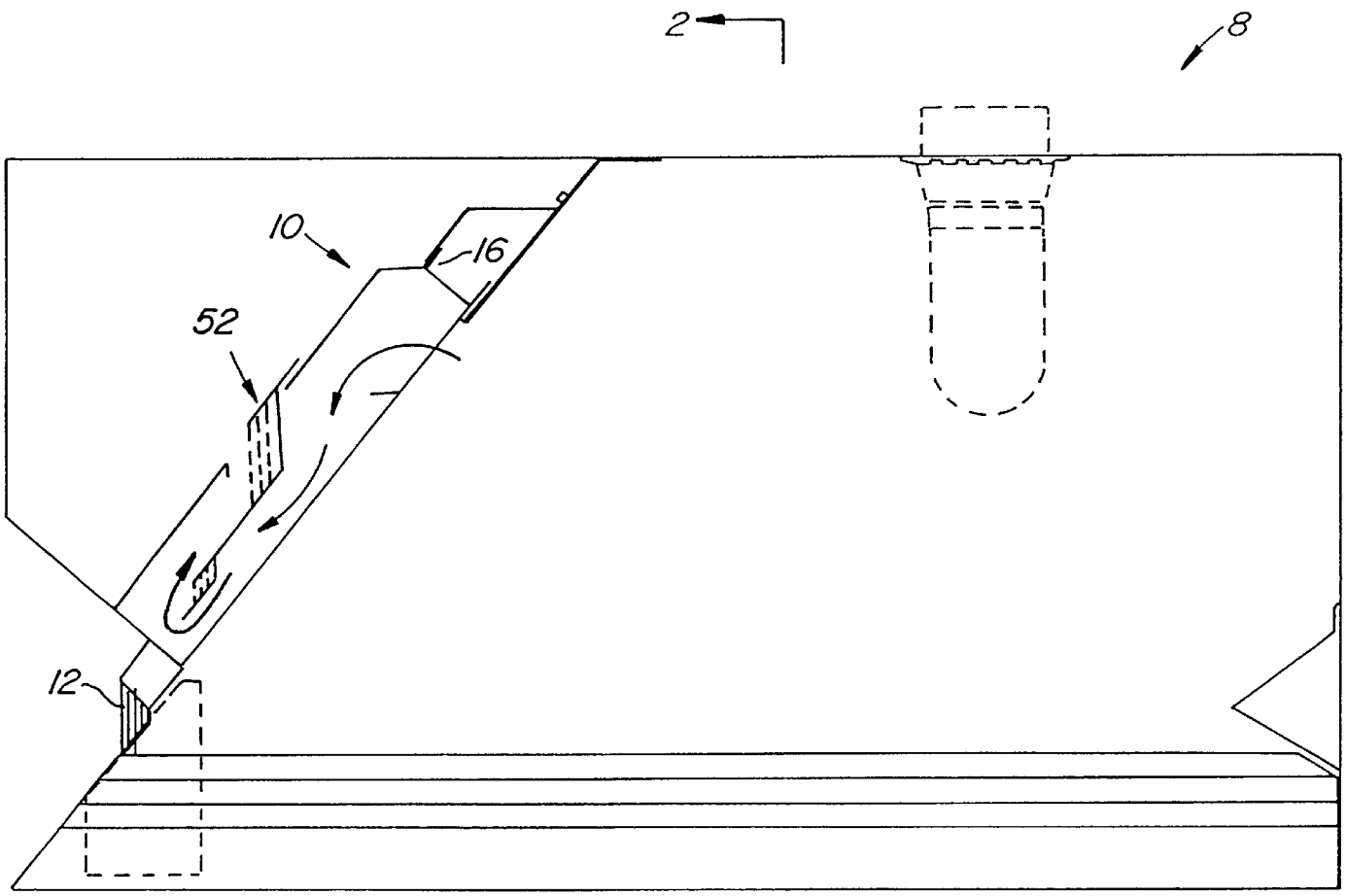
FIG. 1 is a side view of a cartridge filter installed in a cartridge ventilation hood schematically illustrating an embodiment of the present invention.
Figure 2:
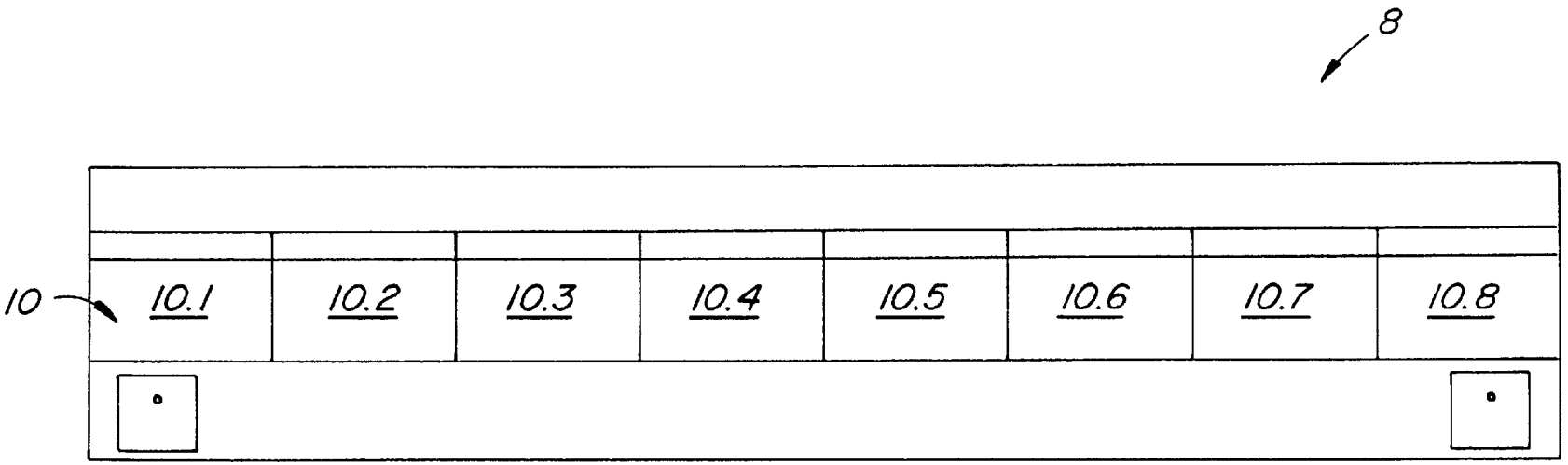
FIG. 2 is a partial cross-sectional view of the ventilation hood of FIG. 1 along 2—2.

Referring to the schematic illustration of FIG. 1, a cartridge ventilation hood 8 is typically disposed above one or more cooking units (not shown). The ventilation hood 8 employs a fan (not shown) to remove the polluted air and exhaust it out of the kitchen, as generally indicated by the curved arrows. A cartridge filter 10 is disposed in the upper rear portion of the ventilator 8 to regulate the air flow through the hood 8. As seen in FIG. 1, the air enters the cartridge filter 10 from one side and exits the filter 10 on the other side in a controlled manner. It is noted that other arrangements are possible. A grease trough 12 is disposed below the cartridge filter 10. The cartridge filter 10 desirably has a substantially open and unobstructed, more desirably fully open, bottom 15 so that grease does not accumulate inside the cartridge filter 10, but flows to the grease trough 12. In this embodiment, the cartridge filter 10 is inclined by about 45°., but other arrangements are possible. The partial cross-sectional view of FIG. 2 illustrates a row of the cartridge filters 10 corresponding to associated cooking units (not shown). The cartridge filter 10 rests into the slot provided in the ventilation hood 8 with the upper locking portion 16 releasably secured to the hood 8. The details of the cartridge ventilation hood 8 are generally known in the art and will not be discussed.

Referring to FIGS. 3–7, the cartridge filter 10 comprises a filter housing 20 that includes a front wall 22, a back wall 24 spaced from the front wall 22 by a wall spacing, a right wall 26 (see FIGS. 4 and 6) connected between the front wall 22 and back wall 24, and a left wall 28 (see FIGS. 4 and 6) connected between the front wall 22 and back wall 24 and spaced from the right wall 26. The left wall is removed from FIGS. 3 and 5 for convenience to show the interior more clearly.

Figure 5:
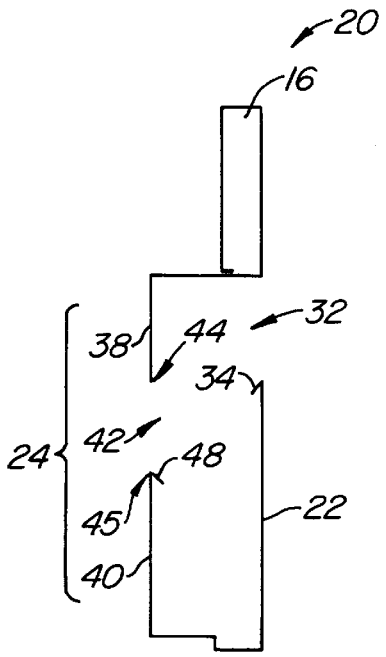
FIG. 5 is a side view of the housing of the cartridge filter of FIG. 3.
Figure 6:
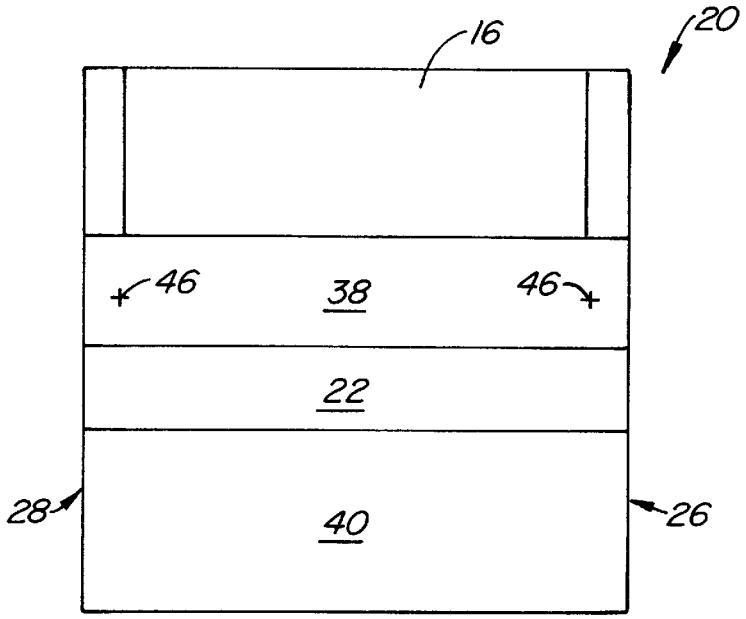
FIG. 6 is a rear elevational view of the cartridge filter of FIG. 3.

The back wall 24 is connected to the upper locking portion 16, while the upper edge of the front wall 22 is spaced from the upper locking portion 16 to define a front wall opening 32. The front wall 22 includes at the upper edge a front baffle 34 that is desirably inclined down. In this embodiment, the incline for the front baffle 34 is about 45°. The back wall 24 comprises an upper back wall portion 38 and a lower back wall portion 40 spaced from the upper portion by a back wall opening 42. The back wall opening 42 is defined between an upper portion edge 44 of the upper back wall portion 38 and a lower portion edge 45 of the lower back wall portion 40 as best seen in FIG. 5. The back wall opening 42 is desirably displaced or offset vertically relative to the front wall opening 32. The upper back wall portion 38 includes a pair of apertures 46. The lower back wall portion 40 comprises a lower back baffle 48 that extends toward the front wall 22. In this embodiment, the lower back baffle 48 is relatively short and inclined downward relative to the lower back wall portion 40 by about 45°.

Figure 3:
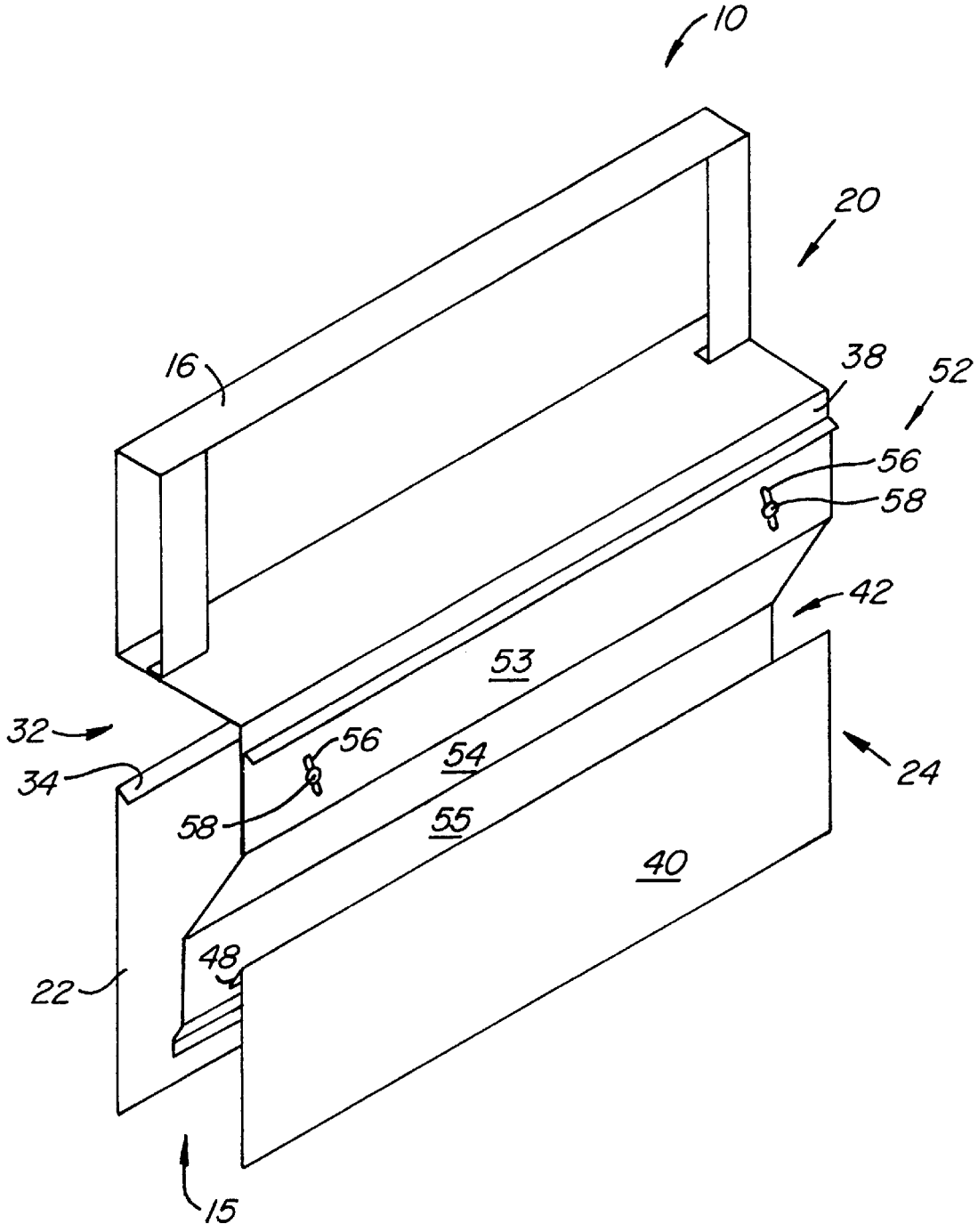
FIG. 3 is a perspective view illustrating the cartridge filter of FIG. 1.
Figure 4:
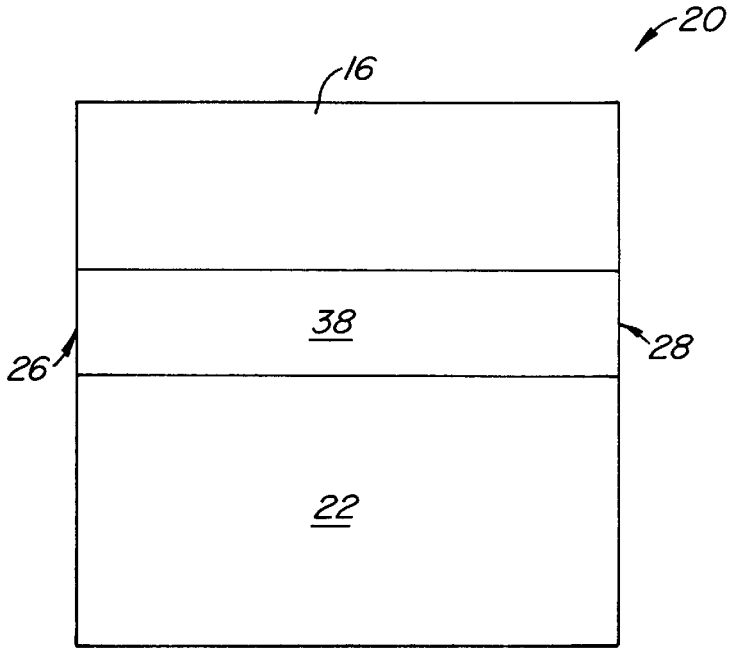
FIG. 4 is a front elevational view of the cartridge filter of FIG. 3.

As shown in FIGS. 3–7, the cartridge filter 10 includes an adjustable flow diverter and choke 52 obstructively disposed at the back wall opening 42 between the upper back wall portion 38 and the lower back wall portion 40. The flow diverter 52 comprises a rear diverter portion 53, an inclined middle diverter portion 54, and a front diverter portion 55. The rear diverter portion 53 includes a pair of generally parallel slots 56 that correspond to the pair of apertures 46 in the upper back wall portion 38, and is adjustably coupled to the upper back wall portion 38 by a pair of studs or other fasteners 58 extending through the slots 56 and the apertures 46 (FIG. 3). The pair of fasteners 58 advantageously couple the flow diverter 52 to the housing 20 in a releasable manner, such that the pair of fasteners 58 may be easily loosened to change the relative positions of the flow diverter 52 to the housing 20 and refastened to secure the two members in a different configuration. The number of the fasteners 58 as well as the number of apertures 46 and slots 56 may vary.

Figure 7:
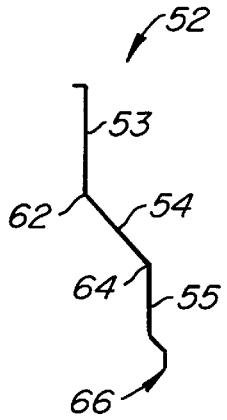
FIG. 7 is a side view of the flow diverter in the cartridge filter of FIG. 3.

As best seen in FIG. 7, the rear diverter portion 53 of the flow diverter 52 is connected to the inclined middle diverter portion 54 at a rear interface 62, and the inclined middle diverter portion 54 is connected to the front diverter portion 55 at a front interface 64. The front diverter portion 55 extends to a lower edge 66 which is desirably below the lower portion edge 45 of the lower back wall portion 40 of the housing 20.

The front diverter portion 55 is spaced from the front wall 22 to define a front diverted spacing or high velocity corridor 100, and is spaced from the lower back wall portion 40 to define a rear diverted spacing or high velocity corridor 102. The rear interface 62 of the rear diverter portion 53 is spaced from the lower back baffle 48 of the lower back wall portion 40 to define an adjustable choke spacing 104, which is equal to the back wall opening 42 minus the portion that is blocked by the flow diverter 52 (i.e., the portion blocked by the rear diverter portion 53 of the flow diverter 52). In this embodiment, the front diverter portion 55, the rear diverter portion 53, the front wall 22, and the back wall 24 are generally parallel.

Figure 8:
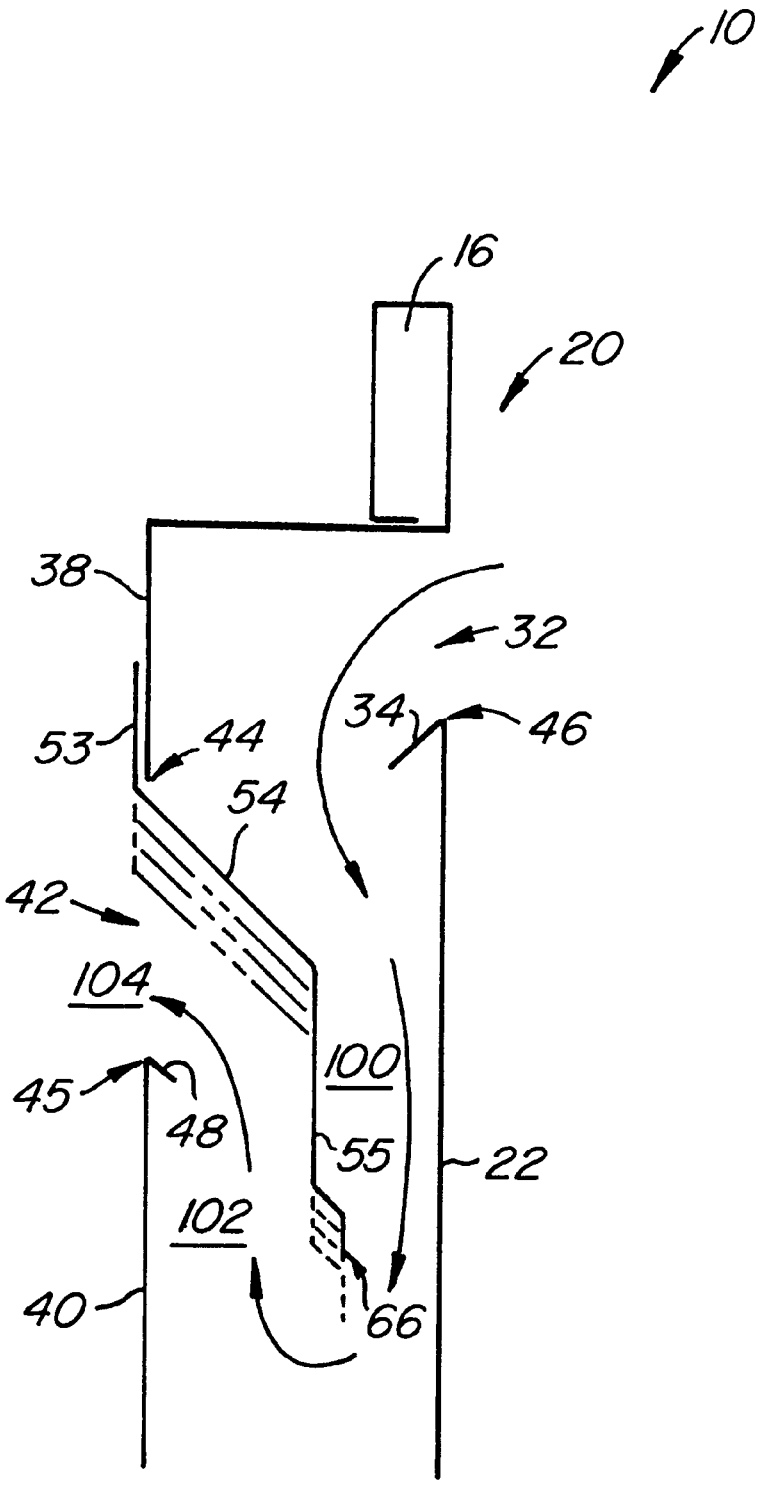
FIG. 8 is a partial cross-sectional view of the cartridge filter of FIG. 3 schematically illustrating the air flow through the cartridge filter.

The adjustment of the flow diverter and choke 52 relative to the housing 20 is illustrated in FIG. 8, which shows different positions of the flow diverter 52. The front diverter portion 55 serves as a front diverter and spacing adjustment portion that, when moved, causes a change in the length of the front high velocity corridor 100 between the front wall 22 and the front diverter portion 55, and the length of the rear corridor 102 between the front diverter portion 55 and the lower back wall portion 40. The rear diverter portion 53 serves as a rear choke spacing adjustment portion that, when moved, causes a change in the adjustable choke spacing 104 between the rear interface 62 of the flow diverter 52 and the lower back baffle 48. A gas flows from the front wall opening 32 through the front high velocity corridor 100 in a first direction, around the lower edge 66 of the front diverter portion 55, through the rear corridor 102 in a second direction which is substantially opposite from the first direction, to the back wall opening 42.

It should be kept in mind the fact that consistent exhaust fan will consistently exhaust the same volume of air until it encounters greater or lessor amounts of resistance which will respectively increase or decrease the volume of air exhausted and the fact that an exhaust fan will exhaust air from the point of least resistance.

The front high velocity corridor 100, rear corridor 102, and choke spacing 104 will determine the amount of resistance the exhaust fan will encounter in this cartridge. As these spacings are increased or decreased, the amount of resistance the exhaust fan has to overcome is respectively decreased or increased with regard to this cartridge which is one of many within the cartridge hood of FIG. 2. The front high velocity corridor 100 and rear corridor 102 for each cartridge filter 10 are typically fixed, and can be determined by selecting the flow diverter and choke 52 with the desired dimensions. The rear corridor 102 is typically larger than the front high velocity corridor 100 in spacing to facilitate a high velocity flow in the front high velocity corridor 100 due to the flow restriction, although the relative sizes of these two spacings can be selected as desired.

Referring to FIG. 2, if the front high corridor spacing 100 and/or rear high corridor spacing 102 for cartridge 10.1 are less than those of cartridges 10.2–10.8, then the exhaust fan will have to overcome greater resistance to exhaust air through cartridge 10.1, thus the exhaust fan which exhausts air from the point of least resistance will exhaust a greater amount of air through cartridges 10.2–10.8 where the resistance is less. As more air is exhausted through cartridges 10.2–10.8 this will also increase the amount of resistance to the exhaust fan. When the resistance becomes equal in all cartridges the system will balance and the new air flows through the cartridges will remain constant. The installer can readjust the flow diverter 52 at anytime to achieve the most desirable air flow segmenting for optimum exhaust and filtration.

The polluted air enters through the front wall opening 32 and encounters two immediate direction changes forced by the front baffle 34 at the front wall 22 and the inclined middle portion 54 of the flow diverter 52. These immediate direction changes start the segmenting of the heavier pollutants from the lighter air. The air flow then enters the high velocity corridor 100 formed by the front diverter portion 55 and the front wall 22. The entire flow is sped up and then goes through a drastic turn of direction of about 180° from the front high velocity corridor 100 to the rear corridor 102. The angle of turn from the front high velocity corridor 100 to the rear corridor 102 is approximately 180° in this case, which provides a higher extraction efficiency of grease or other pollutants than the case where a smaller angle of turn is used. The high rate of air speed through the front high velocity corridor 100 and the sudden change in direction discussed above and shown in FIG. 8 are advantageous because these features facilitate grease extraction. The separated heavier pollutants are unable to follow the lighter air flow around the sudden change of direction at the end of the front high velocity corridor 100. Thus the momentum of the grease carries it to the bottom 15 of the cartridge where it impinges with the cartridge, and then drains into the grease trough 12 provided in the cartridge hood.

Advantageously as the front diverter portion 55 is moved further downward, it forms a longer front high velocity corridor 100 and a longer rear corridor 102, thereby creating greater amounts of resistance to the exhaust fan in that cartridge in relation to the other cartridges of FIG. 2, and reducing the amount of air flow through that cartridge in relation to the other cartridges. As the rear diverter portion 53 is moved closer to the lower portion edge 45 of the lower back wall 40, the amount of air flow through that cartridge in relation to the other cartridges is respectively decreased. As a result, the flow diverter 52 works to create additional resistance against the exhaust fan. When the flow diverter 52 is used to increase the resistance to the exhaust fan relative to the other cartridges, the air flow through the cartridge is reduced. As a result of the increased length of the corridors 100, 102 and the reduced choke spacing 104, however, the air flow through the corridors 100, 102 maintains the high rate of air speed that is required for optimum grease extraction.

The front diverted spacing 100, rear diverted spacing 102, and choke spacing 104 determine the flow pattern through the cartridge filter 10. It is understood that a different incline angle for the middle diverter portion 54 and different spacings 100, 102 may be used. The selectability and adjustability of the flow diverter 52 provide a robust cartridge filter 10 that can be used in a variety of ventilation hoods for different applications without expensive and time-consuming installation. The cartridge filter 10 can be easily removed, cleaned, adjusted, and reinstalled.

Figure 9:
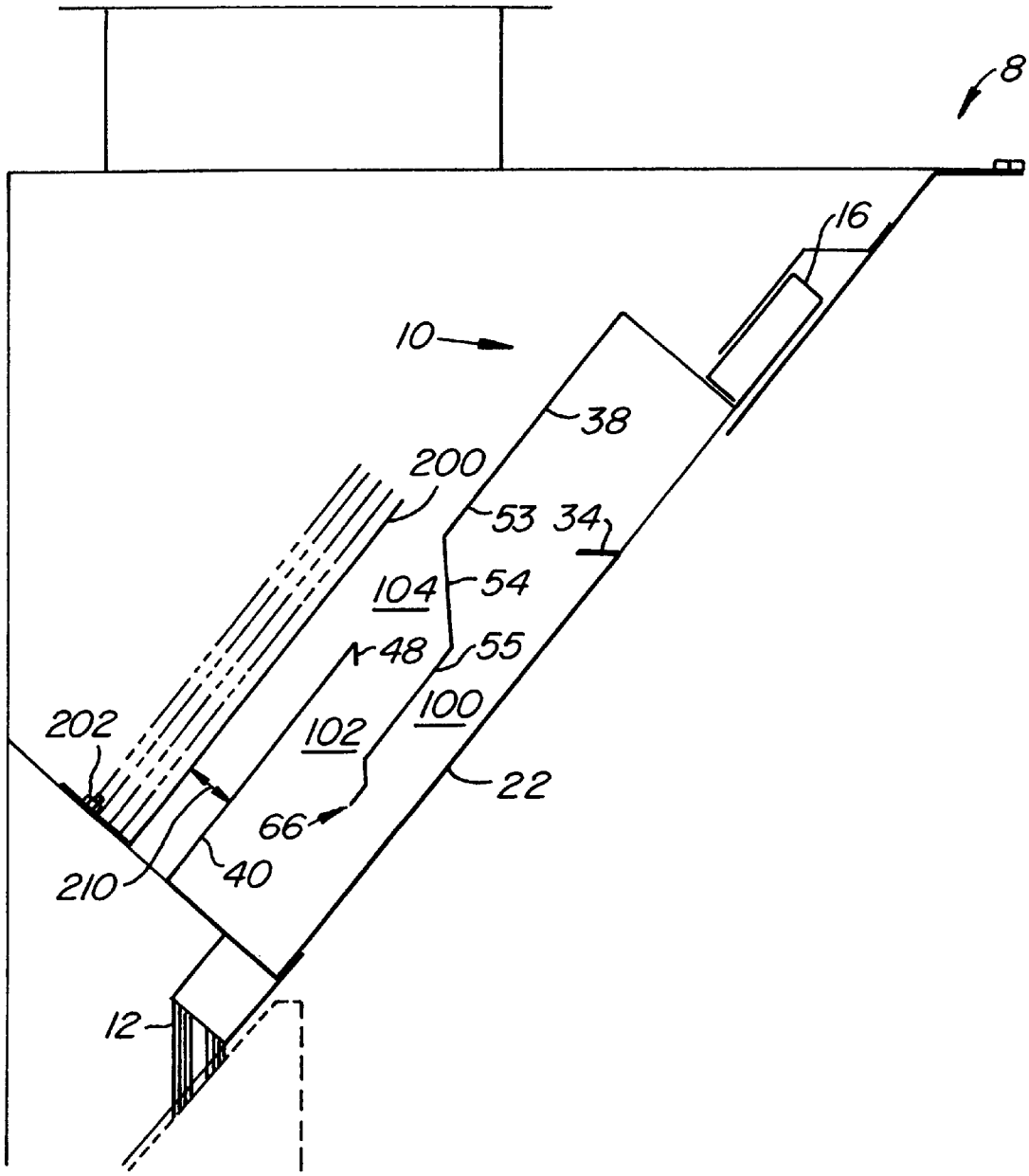
FIG. 9 is a side view of a cartridge filter installed in a cartridge ventilation hood schematically illustrating another embodiment of the invention.

Another embodiment of the invention is shown in FIG. 9, which includes the cartridge filter 10 of FIGS. 1–8 and an adjustable rear choke portion 200. In FIG. 9, the flow diverter 52 inside the cartridge filter 10 may be fixed as shown or movable as illustrated in FIG. 8. The adjustable rear choke portion 200 is disposed outside of the filter 10 about the choke spacing 104. The rear choke portion 200 comprises a plate having a generally flat surface that is larger in area than the choke spacing 104, and is adjustably fastened to the hood 8 with fasteners 202. The rear choke portion 200 has slots (not shown) along which the fasteners 202 may slide to adjust the position of the rear choke portion 200 relative to the choke spacing 104 and lower back wall portion 40. The rear choke portion 200 is spaced from the rear diverted spacing 104 and lower back wall portion 40 by an adjustable rear choke spacing 210.

Advantageously as the rear choke portion 200 moves closer to or away from the choke spacing 104 and lower back wall portion 40, it creates greater or lessor amounts of resistance to the exhaust fan in that cartridge in relation to the other cartridges of FIG. 2, thus reducing or increasing the amount of air flow through that cartridge in relation to the other cartridges. As the rear choke portion 200 is moved closer to or further from the choke spacing 104 and lower back wall portion 40, it controls the size of the rear choke spacing 210 and the flow rate through the corridors 100, 102. When the rear choke portion 200 is used to increase the resistance on the exhaust fan relative to the other cartridges, the rear choke spacing 210 is reduced. Because of the increased resistance in this cartridge relative to the other cartridges, the air flow through the cartridge is reduced.

The above-described arrangements of apparatus and methods are merely illustrative of applications of the principles of this invention and many other embodiments and modifications may be made without departing from the spirit and scope of the invention as defined in the claims.

What is claimed is:

1. An adjustable cartridge filter for use in a cartridge ventilator, the cartridge filter comprising:

a filter housing including a front wall having a front wall opening and a back wall coupled to and spaced from the front wall, the back wall including an upper back wall portion spaced from a lower back wall portion by a back wall opening which is defined between an upper portion edge of the upper back wall portion and a lower portion edge of the lower back wall portion; and a flow diverter disposed obstructively at the back wall opening and being adjustably supported by the housing to move relative to the housing, the flow diverter having a front diverter portion which is disposed between the back wall opening and the front wall and which is spaced from the front wall to define a front diverted spacing and spaced from the back wall to define a rear diverted spacing, the flow diverter having a rear diverter portion which is adjustably coupled to the back wall to move the front diverter portion in a space between the front wall and the back wall to divert a flow of a gas from the front wall opening to the back wall opening so that the gas flows from the front wall opening through the front diverted spacing between the front wall and the front diverter portion in a first direction, around a lower edge of the front diverter portion, through the rear diverted spacing between the back wall and the front diverter portion in a second direction which is substantially opposite from the first direction, to the back wall opening.

2. The cartridge filter of claim 1, wherein the rear diverter portion is adjustably coupled to the back wall to block a portion of the back wall opening to define an adjustable choke spacing equal to a remaining portion of the back wall opening not blocked by the rear diverter portion.

3. The cartridge filter of claim 1, wherein the front diverted spacing is substantially constant.

4. The cartridge filter of claim 1, wherein the rear diverted spacing is larger than the front diverted spacing.

5. The cartridge filter of claim 1, wherein the flow diverter comprises an inclined middle diverter portion connected between the front diverter portion and the rear diverter portion, the inclined middle diverter portion connected to the front diverter portion at a front interface and connected to the rear diverter portion at a rear interface.

6. The cartridge filter of claim 5, wherein the flow diverter is movable between a first position where the rear interface of the flow diverter is disposed at the upper portion edge of the back wall opening and a second position where the rear interface of the flow diverter is disposed between the upper portion edge and the lower edge of the back wall opening with the rear diverter portion blocking a portion of the back wall opening from the upper portion edge of the back wall opening to the rear interface of the flow diverter.

7. The cartridge filter of claim 5, wherein the back wall comprises a back baffle at the lower portion edge of the lower back wall portion, the back baffle being substantially parallel to the inclined middle diverter portion of the flow diverter.

8. The cartridge filter of claim 1, wherein the lower edge of the front diverter portion is disposed lower than the lower portion edge of the lower back wall portion.

9. The cartridge filter of claim 1, wherein the front wall further comprises a front baffle at a boundary of the front wall opening, wherein the front baffle extends partly toward the flow diverter.

10. The cartridge filter of claim 1, further comprising a rear choke portion disposed about the filter housing and spaced from the back wall of the filter housing.

11. The cartridge filter of claim 10, wherein the rear choke portion is adjustably mounted with respect to the filter housing and spaced from the back wall by an adjustable rear choke spacing.

12. The cartridge filter of claim 10, wherein the rear diverter portion is adjustably coupled to the back wall to block a portion of the back wall opening to define an adjustable choke spacing equal to a remaining portion of the back wall opening not blocked by the rear diverter portion, and wherein the rear choke portion comprises a generally flat surface that is larger in area than the adjustable choke spacing.

13. The cartridge filter of claim 1, wherein the filter housing has a bottom which is substantially open and unobstructed between the front wall and the back wall.

14. An adjustable cartridge filter for use in a cartridge ventilator, the cartridge filter comprising:

a front wall having a front wall opening;

a back wall coupled to and spaced from the front wall, the back wall including an upper back wall portion spaced from a lower back wall portion by a back wall opening which is defined between an upper portion edge of the upper back wall portion and a lower portion edge of the lower back wall portion;

a flow diverter disposed obstructively at the back wall opening and including a front diverter portion which is disposed between the back wall opening and the front wall and which is spaced from the front wall to define a front diverted spacing and spaced from the back wall to define a rear diverted spacing; and means for movably coupling the flow diverter to the back wall to move the flow diverter in a space between the front wall and the back wall to divert a flow of a gas from the front wall opening to the back wall opening so that the gas flows from the front wall opening through the front diverted spacing between the front wall and the front diverter portion in a first direction, around a lower edge of the front diverter portion, through the rear diverted spacing between the back wall and the front diverter portion in a second direction which is substantially opposite from the first direction, to the back wall opening.

15. The cartridge filter of claim 14, wherein the means is configured to move the flow diverter to change the size of the back wall opening.

16. The cartridge filter of claim 14, wherein the flow diverter comprises a rear diverter portion having a plurality of apertures and wherein the upper back wall portion includes a plurality of slots that are movably coupled to the plurality of apertures with releasable fasteners for moving the flow diverter relative to the back wall.

17. The cartridge filter of claim 16, wherein the flow diverter comprises an inclined middle diverter portion connected between the front diverter portion and the rear diverter portion, the inclined middle diverter portion connected to the front diverter portion at a front interface and connected to the rear diverter portion at a rear interface.

18. The cartridge filter of claim 17, wherein the flow diverter is movable between a first position where the rear interface of the flow diverter is disposed at the upper portion edge of the back wall opening and a second position where the rear interface of the flow diverter is disposed between the upper portion edge and the lower edge of the back wall opening with the rear diverter portion blocking a portion of the back wall opening from the upper portion edge of the back wall opening to the rear interface of the flow diverter.

19. The cartridge filter of claim 14, further comprising a rear choke portion spaced from the back wall and adjustably mounted to move with respect to the back wall and the back wall opening.

20. The cartridge filter of claim 14, wherein the flow diverter is movable in a direction substantially parallel to the front wall and the back wall.

21. A cartridge ventilator comprising:

a ventilator hood;

a cartridge filter housed in the ventilator hood, the cartridge filter comprising a filter housing including a front wall having a front wall opening and a back wall coupled to and spaced from the front wall and having a back wall opening, the cartridge filter further comprising a flow diverter disposed obstructively at the back wall opening and having a front diverter portion spaced from the front wall to define a front diverted spacing and spaced from the back wall to define a rear diverted spacing, the flow diverter having a rear diverter portion coupled to the front diverter and blocking a portion of the back wall opening to define a choke spacing equal to a remaining portion of the back wall opening not blocked by the rear diverter portion, the front diverter portion extending in a space between the front wall and the back wall to divert a flow of a gas from the front wall opening to the back wall opening so that the gas flows from the front wall opening through the front diverted spacing between the front wall and the front diverter portion in a first direction, around a lower edge of the front diverter portion, through the rear diverted spacing between the back wall and the front diverter portion in a second direction which is substantially opposite from the first direction, to the back wall opening; and a rear choke portion coupled to the ventilation hood and obstructively spaced from the choke spacing.

22. The cartridge ventilator of claim 21, wherein the rear choke portion comprises a generally flat surface being larger in area than the choke spacing.

23. The cartridge ventilator of claim 21, wherein the rear choke portion is adjustably coupled to the ventilation hood to move relative to the back wall and choke spacing.

24. The cartridge ventilator of claim 21, wherein the flow diverter is adjustably supported by the filter housing to adjust the choke spacing.

* * * * *